United States Patent [19]

Schrauwen

[11] Patent Number: 4,901,292

[45] Date of Patent: Feb. 13, 1990

[54] METHOD FOR THE POSITION DETECTION OF THE STRIP EDGE OF A MATERIAL WEB

[75] Inventor: Hans-Joachim Schrauwen, Hiddenhausen, Fed. Rep. of Germany

[73] Assignee: AEG Aktiengesellschaft, Frankfurt, Fed. Rep. of Germany

[21] Appl. No.: 888,322

[22] PCT Filed: Nov. 9, 1985

[86] PCT No.: PCT/EP85/00598

§ 371 Date: Jul. 11, 1986

§ 102(e) Date: Jul. 11, 1986

[87] PCT Pub. No.: WO86/02913

PCT Pub. Date: May 22, 1986

[30] Foreign Application Priority Data

Nov. 17, 1984 [DE] Fed. Rep. of Germany ..... 3442154

[51] Int. Cl.[4] ..... G01S 3/80

[52] U.S. Cl. ..... 367/118; 367/902; 367/124

[58] Field of Search ..... 367/118, 902, 124

[56] References Cited

U.S. PATENT DOCUMENTS

| | | | |
|---|---|---|---|
| 4,176,337 | 11/1979 | Aechter et al. | 367/118 |
| 4,221,004 | 9/1980 | Combs et al. | 367/902 |
| 4,247,922 | 1/1981 | Jackson et al. | 367/128 |
| 4,254,478 | 3/1981 | Dumas | 367/902 |

*Primary Examiner*—Thomas H. Tarcza
*Assistant Examiner*—Daniel T. Pihulic
*Attorney, Agent, or Firm*—McGlew & Tuttle

[57] ABSTRACT

A method for the position detection of the strip edge of a material web by means of an ultrasonic detector disposed in the strip edge region uses a transmitter 2 and a receiver 3, the received sound waves being transformed into an electric signal. To be sure to eliminate the influence of reflected waves on the measurement result, the transmitter 2 emits mutually time-shifted single pulses or wave packets. The wave packet (or single pulse) received by the receiver 3 is transformed into a corresponding electric oscillation packet, a limited area of the oscillation packet is scanned and the scan value is stored for further processing. An arrangement for the performance of the method comprises the transmitter 2 which is fed by a pulse train generator 4 the receiver 3 for delivering an electrical signal, an activatable peak rectifier circuit 6 connected to the receiver and an activatable transmission circuit 9 connected to the rectifier for transmission of the peak value to a memory.

7 Claims, 2 Drawing Sheets

METHOD FOR THE POSITION DETECTION OF THE STRIP EDGE OF A MATERIAL WEB

FIELD AND BACKGROUND OF THE INVENTION

The invention relates to a method for the position detection of the strip edge of a material web by means of an ultrasonic detector disposed in the strip edge region and consisting of a transmitter and a receiver, the received sound waves being transformed into an electrical signal.

Various types of equipment are known for edge- or center-exact guiding of material webs. In pneumohydraulic control devices (German Patent No. 15 74 638 and German Publication No. 27 30 737), a pneumatic web edge sensor is used which consists essentially of two nozzles arranged one above the other, namely the transmitter nozzle and the receiver nozzle, which are arranged in the edge region of the material web. The receiver pressure varies as a function of the position of the material web and acts on a diaphragm drive, which in turn conducts a liquid stream proportional to the receiver pressure to a setting element, which is formed as a rule, by a control roller or adjustable reel.

Often, however, the hydraulic amplification is not sufficient to be able to adjust the response sensitivity of the control device in accordance with the technical requirements. In these cases, the response sensitivity can be increased only in that the receiver pressure is increased by increase of the transmitter pressure. When the material webs are thin, however, an undesirable blowing away of the material web takes place.

To avoid this disadvantage, it is a known practice also to use, instead of a pneumatic strip edge sensor, an optical strip edge sensor which consists of a photo-electrical system. Because, due to special characteristics of the installation, the web edge sensors are often subject to severe dirt accumulation, a cover of dirt on the optic system leads to a change in intensity of the light rays and hence to an erroneous measurement.

Lastly, it is also known to probe the strip edge of a material by means of an ultrasonic device consisting of a transmitter and a receiver (publication ECOSONIC of the firm Endress & Hauser GmbH & Co., Maulburg). With the known ultrasonic detectors, however, major falsifications of the measured signal occur due to the fact that the receiver receives not only the test beam but also reflected beams not belonging to the immediate beam path. In particular, if the height or level of the strip between the receiver and the transmitter fluctuates to such an extent that a harmonic ratio is reached for the reflected signals, which is in a ratio to the wave length of the radiated sound, the reflected signals are added or subtracted to or from the direct measurement signals, depending on their phase signals, thus leading to a false measurement value.

SUMMARY OF THE INVENTION

It is the object of the invention to develop the initially defined method for position detection of a strip edge to the effect that undesired reflected waves will, with certainty, have no effect on the measurement result.

According to the invention, this problem is solved in that the transmitter emits mutually time-shifted single pulses or wave packets, the wave packet or single pulse received by the receiver is transformed into a corresponding electric oscillation packet, a limited region of the oscillation packet is scanned, and the scan value is stored for further processing.

As scan value one can use to special advantage the peak value which is determined during the scan period of the oscillation packet region. The procedure therefore is that first—namely with the scanning not activated—a wave packet is emitted by the ultrasonic transmitter and received by the receiver and is transformed into an electric oscillation packet signal. Instead of a wave packet, single pulses can be used. Since the undesired reflection beams get into the receiver only at a later time, it is possible by evaluation or scanning of the first region of the oscillation packet, in which no undesired beats occur as yet, to obtain a measurement value which represents the position of the strip edge with great accuracy. If one limits the scanning region, counted from the beginning of the oscillation packet, to at most three to five periods, the interfering reflections will certainly be eliminated. The entire process repeats cyclically and thus permits a continuous check or monitoring of the material web.

An arrangement for the performance of the method consists in that the transmitter is fed by a pulse generator, that the signal-delivering receiver is connected to an activatable peak rectifier, and the latter to an activatable transmission circuit for the transmission of the peak value to a memory.

To control the method in a given time sequence, a sequence control is provided, which is addressed by a pulse generator. The same pulses are supplied also to the pulse train generator. The sequence control then provides that a given pulse train is sent out from the generator and that the peak value rectifier is activated for a certain scan period at a specific time, the found peak value being subsequently supplied to a memory via a transmission circuit.

The measurement operation can be done both in reflection and in heat irradiation. In the former case, the transmitter and receiver are arranged on the same side of the material web at a certain angle, the beam reflected at the material web constituting the measuring beam. As an alternative, an ultrasonic transducer can be used in known manner alternately as transmitter and receiver. In the case of the irradiation method, the transmitter is on one side and the receiver on the other side of the material web sound waves of different energy getting into the receiver depending on the degree to which the beam is covered up by the web.

DESCRIPTION OF THE PREFERRED EMBODIMENT

Figure 1:
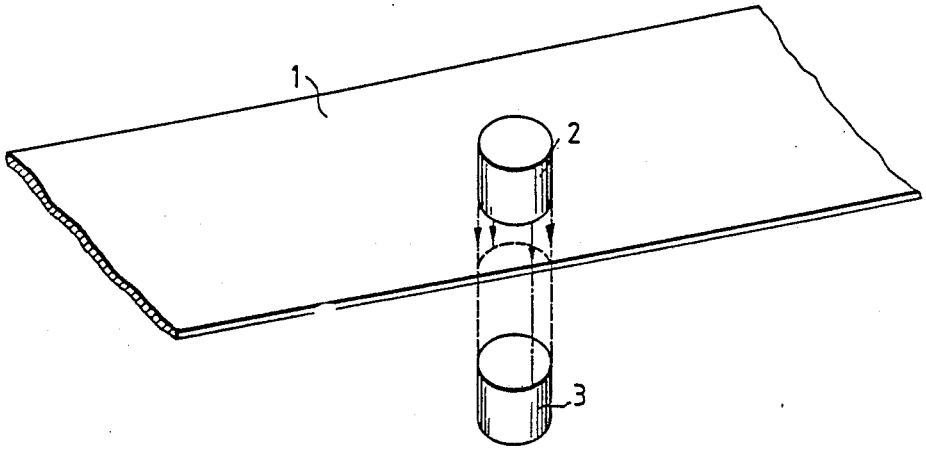
FIG. 1 is a perspective view showing a general measuring arrangement with an ultrasonic detector.

In FIG. 1, 1 denotes schematically the material web, which is guided over rollers (not shown). Above the material web is a transmitter 2, while a receiver 3 is disposed below the material web. Transmitter 2 and receiver 3 are arrange din the edge region of the material web, so that the sound beam is partially covered up by the material web. Depending on the degree of covering, more or less acoustic energy reaches the receiver. This represents a measure of the position of the strip edge or material web. Instead of the irradiation method, the reflection method (not shown) may be used. In this case, the transmitter and receiver are disposed on one side of the material web at a suitable angle. The sound beam delivered by the transmitter is reflected at the material web and then passes into the receiver. As has been mentioned before, however, also at other points reflected beams enter into the receiver additionally, which intensify or weaken the measured beam and thus lead to a falsification of the measurement result.

Figure 2:
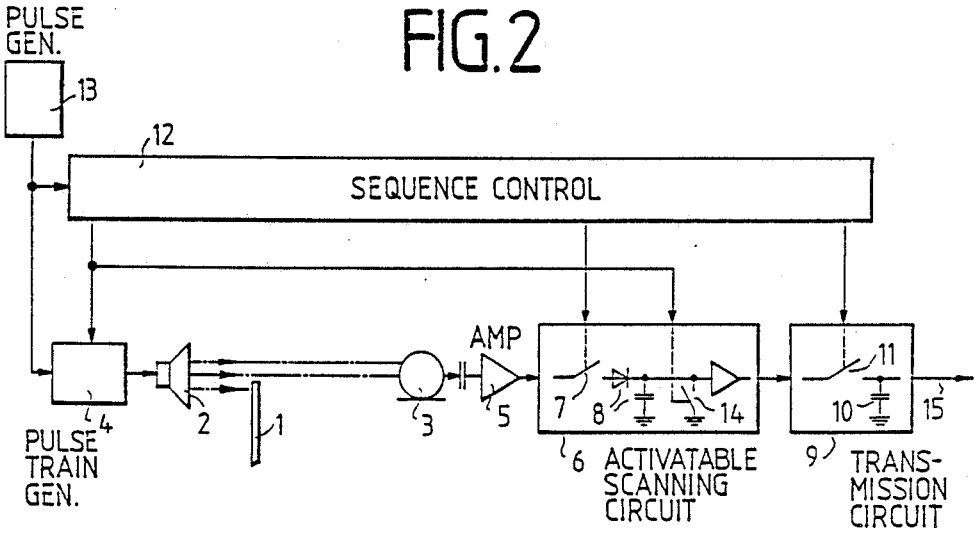
FIG. 2 is a schematic representation of an arrangement for the performance of the method according to the invention.

In FIG. 2, again the material web 2 and the receiver 3 are illustrated schematically. The ultrasonic transmitter 2 is fed by a pulse train generator 4, which delivers a certain pulse sequence of given repetition frequency. As has been mentioned before, the method can be carried out with single pulses. In this case, a pulse generator is used at 4 instead of the pulse train generator. In the transmitter this electric pulse sequence is transformed into a sound wave packet, emitted by 2, and receiver by the receiver 3 as a sound wave packet, the received energy depending on the degree to which the beam is covered up by the material web.

In the receiver 3, the sound waves are transformed directly into electric signals, possibly amplified in an amplifier 5, and then supplied to activatable scanning means or circuit 6. The scanning circuit 6 comprises a switch 7 which supplies the signal delivered by the amplifier 5 to a peak rectifier 8. The peak rectifier 8 consists, for example, of the combination of a diode with a capacitor, as is illustrated symbolically. After completion of the scan period, switch 7 is opened and the value retained in the peak rectifier is supplied to a memory (not shown) by means of a transmission circuit 9. The transmission circuit 9 may consist, for example, of a switch 11 and a capacitor 10. By closing the switch 11, the charge is transmitted from the peak rectifier 8 to the capacitor 10 and then supplied for further processing to the memory (not shown) over a line 15.

Figure 3:
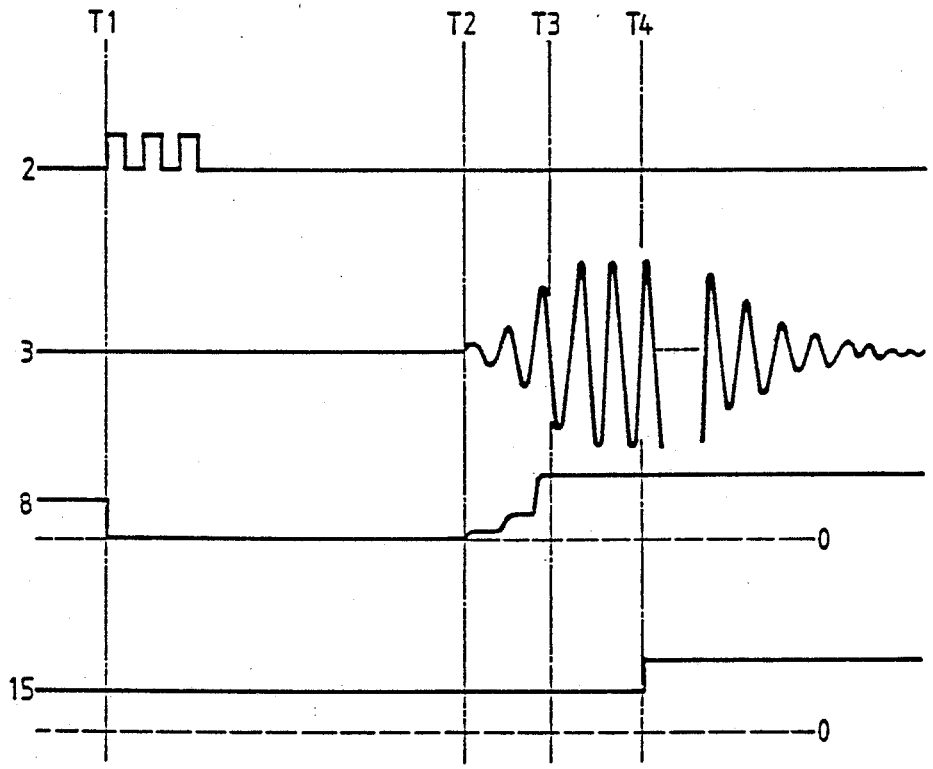
FIG. 3 is a sequence diagram to explain the process sequence.

To explain the operation, FIG. 3 will be used. A sequence control 12 (FIG. 2) is addressed by a pulse generator 13, which at the same time delivers pulses to the pulse train generator 4. at time T1 (FIG. 3) the sequence control closes a switch 14 in circuit 6 and activates the pulse train generator 4, which delivers, for example, a pulse train consisting of three pulses. Consequently, the transmitter 2 (whose output is shown at 2 in FIG. 3) emits a wave packet with the same period duration.

At time T2, switch 14 is opened via the sequence control 12, and switch 7 is closed. The time difference T2−T1 corresponds approximately to the transit time of the sound waves from the transmitter 2 to the receiver 3. Switch 7 remains closed so long that approximately three periods (see the output of receiver 3 at 3 in FIG. 3) are picked up by the scanning circuit 6. At time T3, switch 7 opens, and the peak rectifier 8 (see its state at 8 in FIG. 3) retains the peak value which occurs in the time span T3−T2. At time T4, switch 11 is closed and the peak value is transmitted as a signal on line 15, to a memory. Thereafter,t he peak rectifier is set to zero again, and the cycle begins anew. In this way, it is ensured that during the scan period only the measurement signal is picked up and that no interfering reflections which would arrive at a later time, influence the measurement value.

I claim:

1. A method for detecting the position of a material web edge, comprising the steps of: transmitting a plurality of ultrasonic wave packets from a transmitter to the web material adjacent the material web edge, each wave packet having at least one pulse, the transmission of said wave packets being spaced in time from each other by a selected amount with a first wave packet being transmitted at time T1; receiving said wave packets at an ultrasonic receiver and transforming said wave packets into electric oscillation packets, the first wave packet being received and transformed at time T2, the time interval between time T1 and T2 being substantially as long as the time required for sound waves to travel a distance between the transmitter and the receiver; scanning each electric oscillation packet with an electronic signal analysis device for a scanning period, a first oscillation packet being scanned for a scanning period beginning at time T2 and ending at time T3 to obtain a peak scan value during said scanning period for each oscillation packet scanned; inactivating the electronic signal analysis device after the scanning period for each electric oscillation packet; storing the peak scan value of each oscillation packet, the first oscillation packet being stored at time T4; choosing the time interval T3 minus T1 between the end of the scanning interval and the transmission of a wave packet to be shorter than the time interval required for an interfering echo signal, which has been emitted by the transmitter at time T1, to be reflected to the receiver and choosing the time interval between transmission of the first wave packet and transmission of a second wave packet to be as long as the time required for the interfering echo signal of the first wave packet to have faded.

2. A method according to claim 1, wherein each wave packet comprises from three to five pulses having selected periods, said second selected amount of time corresponding to from three to five periods of said pulses.

3. A method according to claim 1, wherein: said period of time for scanning each electric oscillation packet corresponding to the period of pulse in the ultrasonic wave packet transmitted by the transmitter.

4. An apparatus according to claim 3, wherein said control means for activating said transmission circuit to receive said value from said peak rectifier and to transmit said peak value as a data value for determining the position of the material web edge.

5. An apparatus according to claim 4, wherein said transmitter is positioned on one side of the material web and said receiver is positioned on an opposite side of the material web.

6. An apparatus according to claim 4, wherein said peak rectifier comprises an openable and closeable switch connected to said control means for being opened and closed by said control means, a rectifier, said switch being connected between said receiver and said rectifier for applying the electrical signal from said receiver to said rectifier, and a second switch openable and closeable by said control means in synchronism with activation of said pulse train generator, said second switch being connected to said rectifier for removing said peak value therefrom.

7. An apparatus for determining a position of a material web edge of a material web, comprising: an ultrasonic transmitter for transmitting ultrasonic wave packets toward the material web adjacent the material web edge at a predetermined time T1; pulse generating means connected to said ultrasonic t ransmitter for supplying a pulse to said ultrasonic transmitter; an ultrasonic receiver positioned adjacent the material web edge to receive the ultrasonic wave packets, the first wave packet being received at a time T2, the time period between time T2 and time T1 substantially corresponding to the travel time of sound waves between said transmitter and said receiver, said receiver outputting electrical signals in the form of an oscillation packet corresponding to an ultrasonic wave packet transmitted by said transmitter; electronic signal analysis means downstream of said receiver for receiving electronic signals in the form of an oscillation packet, said electronic signal analysis means including a peak rectifier for scanning the oscillation packet for a preset scanning period from time T2 to a time T3 and for generating a peak value corresponding to a peak in the electrical signal from said receiver; and including a selectively activatable transmission circuit connected to said peak rectifier for transmitting the peak value; control means connected to said peak rectifier, connected to said transmission circuit and connected to said pulse train generator for activating said pulse train generator at the time T1, for activating the peak rectifier for a period between time T2 and time T3 and inactivating the peak rectifier after the time T3 and for activating the transmission circuit at a time T4 for the transmission of the peak value to a memory, the scanning period between time T2 and time T3 being shorter than a time interval required for an interfering echo signal, which has been emitted from the transmitter at time T1, to be reflected to the receiver and for choosing the time interval between the transmission of the first wave packet at time T1 and the transmission of a second wave packet to be as long as the time required for the interfering echo signal of the first wave packet to have faded.

* * * * *